United States Patent [19]

Weller

[11] Patent Number: 4,964,802

[45] Date of Patent: Oct. 23, 1990

[54] FREE CREATIVE AMUSEMENT APPARATUS

[76] Inventor: Emily C. Weller, 1300 Bear Mountain Ct., Boulder, Colo. 80303

[21] Appl. No.: 364,574

[22] Filed: Jun. 8, 1989

Related U.S. Application Data

[63] Continuation of Ser. No. 158,234, Feb. 19, 1988, abandoned.

[51] Int. Cl.[5] ..... G09B 19/00; A63H 33/06

[52] U.S. Cl. ..... 434/96; 446/118

[58] Field of Search ..... 434/96; 273/241; 446/117, 118, 168

[56] References Cited

U.S. PATENT DOCUMENTS

| | | | |
|---|---|---|---|
| 510,178 | 12/1893 | Konig . | |
| 1,725,911 | 8/1929 | Graham | 446/118 |
| 2,819,902 | 1/1958 | Dicker | 273/40 |
| 3,518,787 | 7/1970 | Anello et al. | 446/124 |
| 3,604,705 | 9/1971 | Hawthorne . | |
| 3,747,261 | 7/1973 | Salem . | |
| 3,946,516 | 3/1976 | Wirth | 446/117 |
| 4,164,091 | 8/1979 | Lin | 446/26 |
| 4,184,685 | 1/1980 | Wilson . | |
| 4,629,192 | 12/1986 | Nichols . | |
| 4,744,780 | 5/1988 | Volpe | 446/128 |
| 4,772,240 | 9/1988 | Boskovic | 446/170 |

FOREIGN PATENT DOCUMENTS

| | | | |
|---|---|---|---|
| 51182 | 12/1920 | France | 446/117 |

OTHER PUBLICATIONS

"Ball Tilt", HABA Habermaass catalogue, p. 6, 1983.

"Colborn's Catalogue" of Colbarn's, Denver, CO, 12/87.

Colborn's National School Supply & Equipment Association, "HABA" Publication of Habermaass Corporation.

Japanese Gomoku; Use Your Marbles.

Magnetic Marbles.

Judy/Instructo Manipulatives.

*Primary Examiner*—Benjamin Layno

*Assistant Examiner*—Valerie Szczepanik

*Attorney, Agent, or Firm*—Watts, Hoffmann, Fisher & Heinke

[57] ABSTRACT

An apparatus is disclosed for making complex and beautiful arrays of marbles or other translucent decorative objects in a free creative manner. A base has structure defining a rectangular grid for engaging both marbles and structure for supporting marbles above the level of the base. Such supporting structure includes support posts engageable with the base for holding marbles at their respective upper ends and inclined risers, both free standing and supportable for facilitating inclined displays of marbles. Substantially horizontal elevated platform structures, similar in configuration, but smaller than the grid, may also be employed. Flexible and segmented support posts add variety and interest.

34 Claims, 4 Drawing Sheets

FREE CREATIVE AMUSEMENT APPARATUS

This application is a continuation of application Ser. No. 158,234, filed Feb. 19, 1988, now abandoned.

TECHNICAL FIELD

This invention relates generally to the field of toys, games and the like, and more particularly to apparatus and method for facilitating free creative construction of three dimensional arrays of multi-colored mobile, light-transmissive pieces such as marbles.

BACKGROUND ART

Many toys and games exist which employ visual or decorative game pieces or display elements, such as marbles of various colors and transparencies. An example is the popular game known as "Chinese Checkers", which employs a star-shaped board having multiple recesses for accommodating marbles of different colors.

Another type of game employing a two dimensional array of marbles is a Japanese game known as "Gomuku".

Games such as these are not primarily intended as vehicles for artistic design of arrays of different colored marbles. Rather, they are games played by set rules which have nothing to do with the aesthetic characteristics of the arrays which are formed during play of the game.

Additionally, no more than a two dimensional array of marbles is possible with these known games.

It has been proposed, however, to employ large, solid building blocks, each having generally half-round recesses for accommodating marbles in a way which can display marbles at different levels above a base. The building blocks can be stacked in ways determined by the user and marbles can be inserted in the respective recesses.

Such a device, however, is very limited in terms of the flexibility which can be achieved in configuration of the display piece arrays. Only planar arrays are possible and more complex configurations are not available at all. Additionally, the nature of the building blocks interferes with the free flow of light through the visual display elements, which detracts substantially from their aesthetic appeal.

It is a general object of this invention to provide an artistic amusement apparatus facilitating free creative making of a wide variety of three dimensional aesthetically pleasing arrays of visual display elements such as translucent marbles and for enhancing the appearance of such arrays by attractive exposure to light.

DESCRIPTION OF THE INVENTION

The disadvantages of the prior art are reduced or eliminated by the use of an apparatus having facility for enabling a user to construct complex and interesting three dimensional arrays of marbles or other transparent or translucent display elements in free creative form to produce interesting and aesthetically striking patterns.

In accordance with an embodiment of the apparatus, a base grid is provided. The base has structure defining rectangular interstices for accommodating and stationarily holding marbles or display elements placed on the grid.

The apparatus includes the grid, and one or more of several additional supporting parts engageable with the grid or with each other in varieties of predetermined spatial and geometrical relationships.

For example, the apparatus comprises support posts of differing lengths having lower ends engageable in the grid and upper ends suitably adapted to support marbles or other display elements which may be selected. Such support posts facilitate provision of a three dimensional array of display elements.

Support posts such as described above can also be used to support other components, such as platforms, similar to portions of the grid, but elevated above the main grid structure for deployment and holding of larger numbers of display elements.

Inclined displays are possible. Inclined risers engageable with the base are also provided. Some risers are adapted for their upper ends to be supported by other support elements, such as posts or the like. Other risers are adapted to engage only their lower ends, and to stand freely in inclined position without the aid of upper end support.

Support posts, risers, and other parts can be made of colored or clear material, the latter being desirable to facilitate light passage through the support parts and through the supported display elements, and to render the support parts less prominently visible. Preferably, display elements comprised of transparent or translucent materials, such as glass or appropriately selected plastic, such as acrylic.

In accordance to a more specific embodiment, support posts engageable with the base can be made flexible, such that the weight of a marble borne at or near the upper end of a flexible support post will cause the post to deflect, yielding interesting motion, and/or curved lines, to the display.

In accordance with another specific embodiment, segmented support posts, having stackable segments with mutually interfitting ends are used in order to govern the height above the base at which marbles or visual display elements are supported.

The present invention will be understood in greater detail by reference to the following detailed description, and to the drawings.

BEST MODE FOR CARRYING OUT THE INVENTION

Figure 1:
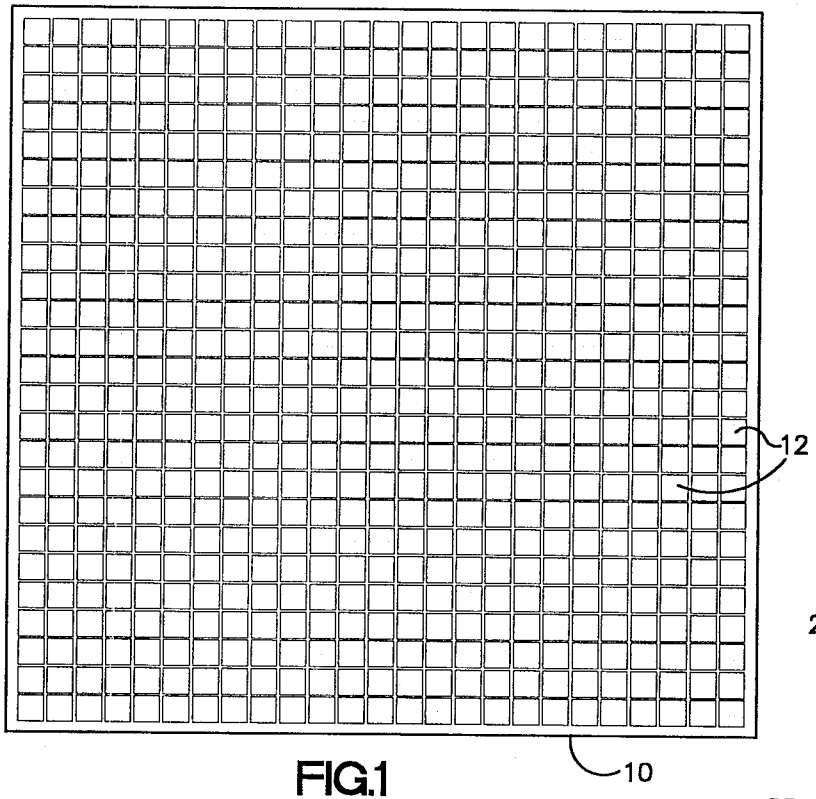
FIG. 1 is a plan view of a base portion of an apparatus embodying the present invention.

An embodiment of this invention includes a base portion 10 (FIG. 1) in the form of a rectangular grid of generally flat configuration, in combination with a plurality of decorative of visual display elements or pieces comprising marbles or the like and other parts for supporting the marbles, which other parts will be described in more detail below. The apparatus provides means by which a user can achieve aesthetically pleasing and interesting patterns of different colored marbles in three dimensions in a freely creative manner.

The grid 10 is a rectangular plastic grid defining a rectangular array of interstices, such as indicated by the reference character 12, suitable for holding stationary by gravity marbles placed on the grid. As such, the interstices 12 have dimensions slightly smaller than the major dimension of the visual display elements which, in the preferred embodiment, constitute marbles.

The grid is made of plastic material having suitable mechanical strength and visual properties. The grid can either be colored or made of clear plastic or the like. Optionally, the grid can be made of metal or other suitable material.

Figure 2:
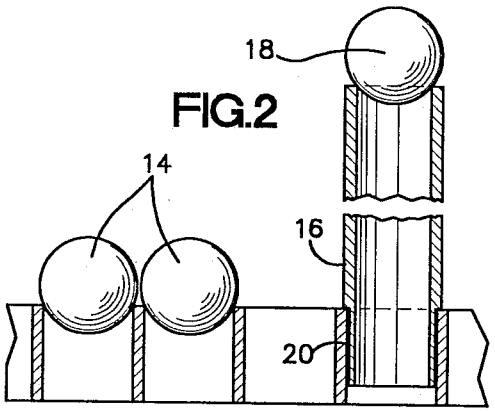
FIG. 2 is a detailed elevational view, taken partially in cross section, of another portion of the present apparatus used in conjunction with the portion of FIG. 1.

Referring to FIG. 2, supporting posts or tubes, engageable with the interstices of the grid, are provided for supporting visual display elements, such as marbles, at different heights above the grid.

FIG. 2 shows two marbles, designated 14 resting in adjacent interstices of the grid, and a marble supporting tubular post 16 also engaged at its lower end in the grid. The tubular post 16 supports a marble 18 resting in its upper end. The lower end of the post 16 is stepped, as at 20, to facilitate engagement in the grid, and to limit the extent to which the post can be inserted into the grid.

The tubular support post member 16 is also made of plastic, which can be either clear or colored. Some of the tubes 16 have a rectangular cross section, while others are round in cross section. Alternately, additional cross sectional shapes are possible for the tubular support member 16.

Figure 3:
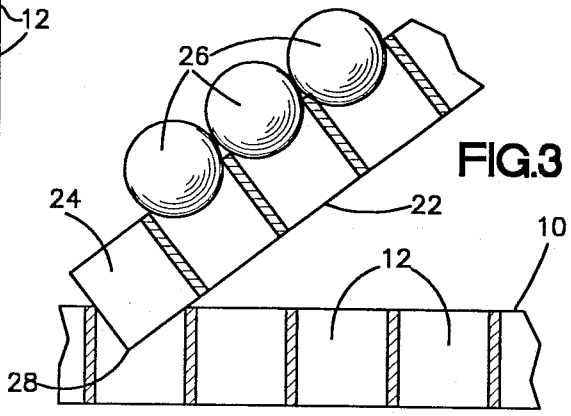
FIG. 3 is a detailed elevational view, partly in cross section, illustrating another part of the present apparatus used in conjunction with the part shown in FIG. 1.

Other parts are included for supporting marbles at different levels or heights above the grid 10. FIG. 3 illustrates an inclined riser 22. The riser 22 includes a series of its own interstices such as 24 arranged in a line, each being sized similarly with the interstices 12 of the base 10 for engagement with marbles such as indicated at 26.

The lower end of the inclined riser 22 is shown resting, as at 28, in one of the grid interstices. The upper end of the inclined riser 22 (not shown) is supported on a structure such as one of the support posts 16 or other suitable apparatus. By use of the inclined riser 22, an inclined array of marbles can be displayed.

Figure 4:
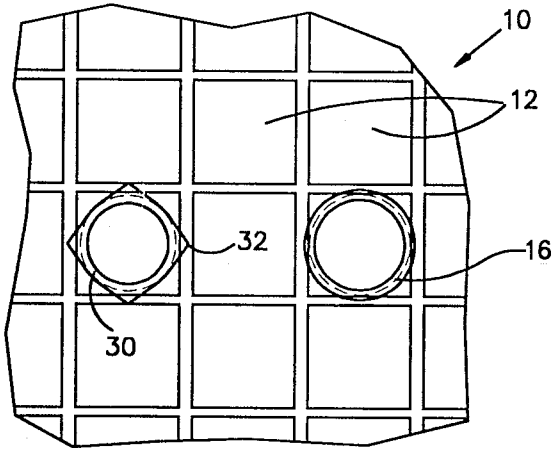
FIG. 4 is a plan view of additional parts of this apparatus used in conjunction with the part shown in FIG. 1.

FIG. 4 is a plan view illustrating two types of support post elements, each engaged in one of the interstices 12 of the grid 10. In the right hand portion of FIG. 4 is shown a support post such as illustrated at 16 in FIG. 2 and having round cross sections. The support post 16 is engaged in the grid and extends upwardly.

Figure 5:
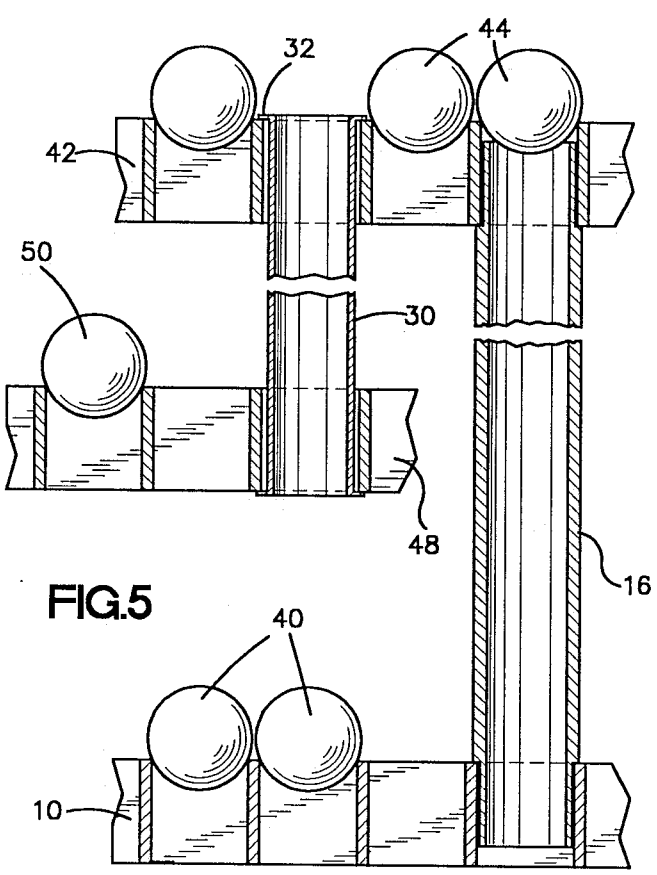
FIG. 5 is a detailed drawing, partly in cross section, of a combination of additional parts of the present apparatus, used in conjunction with the part shown in FIG. 1.

Another type of support post, designated 30, which extends downwardly through the grid as illustrated in FIG. 4, is shown in FIGS. 4 and 5. The downwardly extending support post 30 carries at its upper end an approximately square flange 32.

The lateral dimension of the flange 32 is small enough to permit the flange 32 and its associated downwardly extending support post 30 to pass through the grid when the post 30 is rotated such that the sides of the flange 32 are generally aligned with the sides of the one of the grid interstices through which the post is extended. When the post 30 is rotated 45 degrees, however, as shown in FIG. 4, the flange 32 prevents the post from dropping through the grid.

FIG. 5 illustrates a combination of grid structure, support parts and marbles in a more complex mechanically connected relationship. FIG. 5 shows a portion of the grid 10 with a pair of marbles 40 resting thereon. A support post 16 is engaged in the grid and extends upwardly to carry a horizontal platform element 42. The platform element 42 comprises structure defining a single row of interstices similar to those making up the grid. Marbles such as 44 rest in the interstices of the platform element 42.

The platform element 42 in turn carries a downwardly extending support post 30 such as described and shown in connection with FIG. 4.

At the bottom of the platform post 30 is attached still another horizontal platform element 48 carrying a marble 50. The structure of the platform element 48 is similar to that of the platform element 42.

Optionally, the platform elements such as 42, 48 can comprise structure defining more than one row of interstices, but generally the elements 42, 48 are not as expansive as the grid 10.

Figure 6:
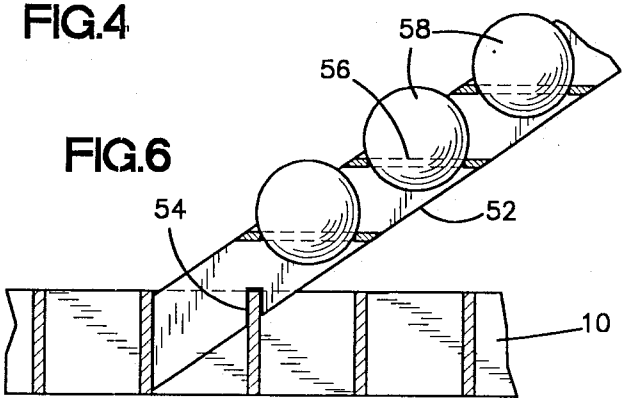
FIG. 6 is a detailed elevational view taken partly in cross section, illustrating still another portion of the present apparatus used in connection with the portion illustrated in FIG. 1.

FIG. 6 illustrates riser structure 52 differing from the riser 22 illustrated in FIG. 3.

The riser 52 is engaged at its lower end with the grid 10, which engagement is facilitated by a notch 54 cut into the lower portion of the riser. The riser 52 is thus supported by only its engagement with the base, and the upper end of the riser (not shown) need not be supplementally supported.

The riser 52 comprises treads such as 56 which are generally horizontal when the riser 52 is engaged in inclined fashion in the base or grid. Each of the treads 56 defines an opening cut therein to facilitate stationary holding or a marble, such as 58, placed on a tread.

Considerable flexibility can be employed in the choice of materials and configurations for the components of the present apparatus. For example, the visual display elements, stated above to comprise marbles, can optionally have shapes other than spherical, such as pyramidal, ovoid, cubicle, etc. The visual display elements can be made of glass, plastic, such as acrylic, or other visually attractive transparent or translucent materials. Preferably, the visual display elements are not opaque.

It is also preferable that the visual display elements be different colored, and even single elements can be multi colored.

A significant aspect of this apparatus is that the components for supporting the visual display elements above the grid are generally open structured, allowing light to pass vertically through both the support structures and any visual display elements which may be placed thereon. Such openness of configuration facilitates transmission of light throughout the display, adding to the striking and pleasing visual effect of displays made with the apparatus.

Figure 7:
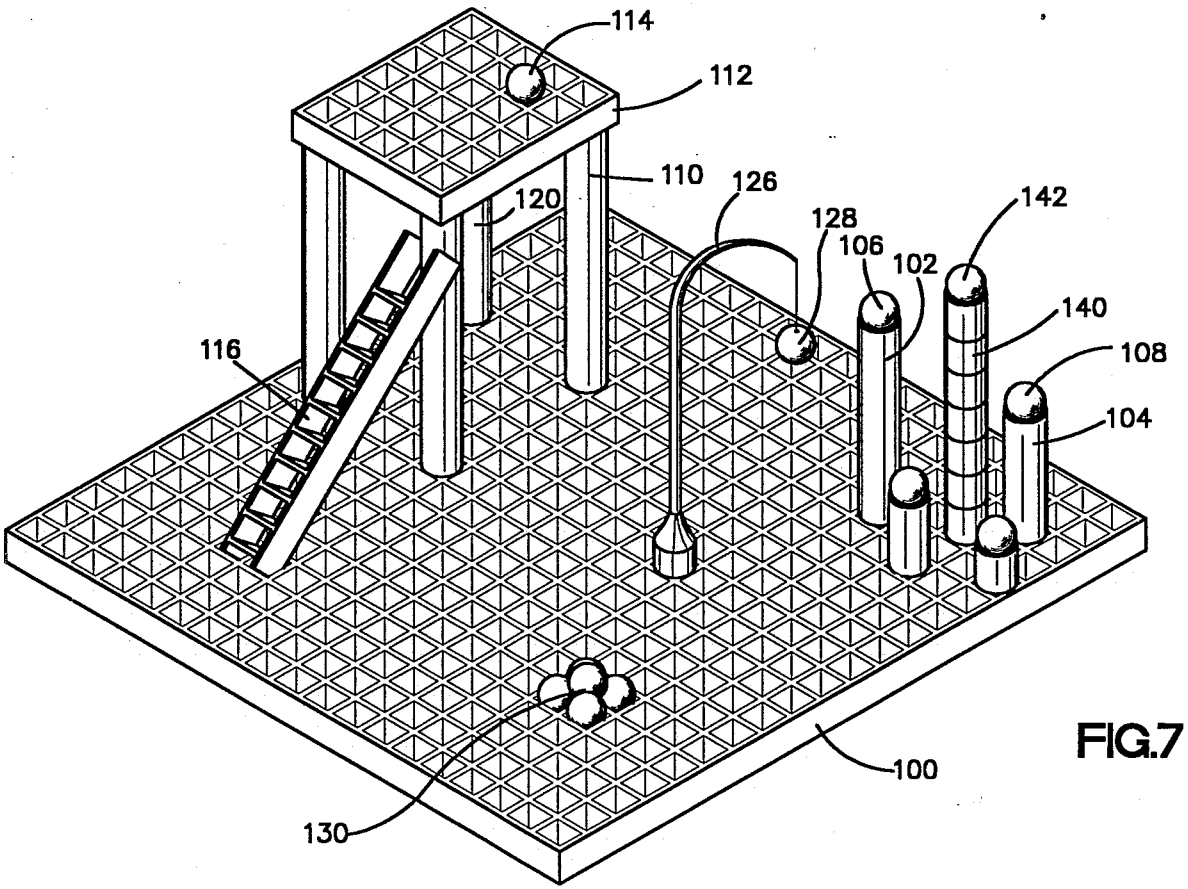
FIG. 7 is a perspective drawing of an assembly of apparatus parts illustrated in FIGS. 1–6.

FIG. 7 shows an assembly of apparatus parts described above. FIG. 7 illustrates a base or grid 100 into which is engaged several support posts such as indicated at reference characters 102, 104. Some of the support post bear marbles in their upper ends such as indicated at 106, 108.

Other support posts, as shown at 110, are engaged in the base to engage with and support elevated horizontal platform elements such as shown at 112. The platform 112 in turn provides support for holding stationary one or more marbles such as indicated at 114.

Risers such as described above can also be employed in this assembly. For example, the assembly of FIG. 7 also shows a supported riser 116 engaged at its lower end in the base 100 and at its upper end with a support post 120. The riser 116 is adapted to support an inclined array of marbles such as illustrated in FIGS. 3 and 6 above. The assembly of FIG. 7 can also accommodate free standing risers such as illustrated FIG. 6. The risers have horizontal or inclined steps, as desired.

Also shown in FIG. 7 is a pryamid-shaped stack of marbles resting upon the base 100.

A flexible support post 126, bearing a marble 128 is also illustrated.

Figure 8:
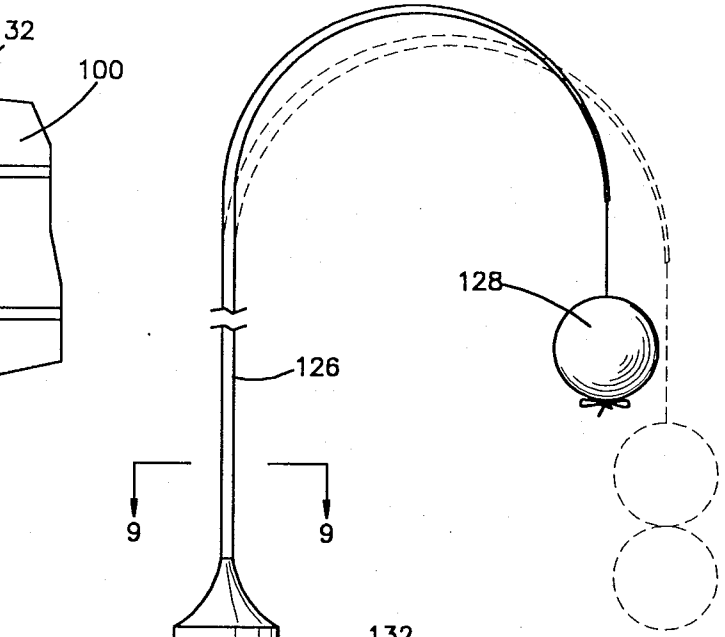
FIGS. 8 and 9 are detailed drawings presenting a further embodiment of another portion of the present invention.
Figure 9:
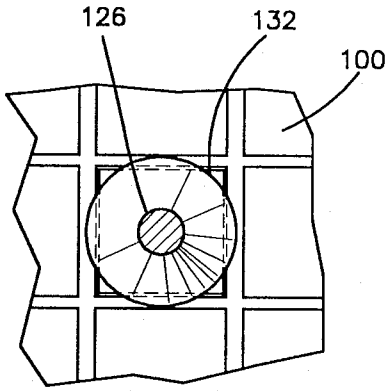

FIGS. 7–9 illustrate the particulars of a flexible support post which provides curved lines to the artistic display. The flexible support post includes a lower portion 132 adapted for engagement in the base 100. This is shown in elevational form in FIG. 8 and in plan view in FIG. 9, as well as in pictorial fashion in FIG. 7. Attached to the upper end of the portion 132 is a portion 126 of flexible material attached at its distal end to a marble 128. As shown in phantom in FIG. 8, the marble and portion 126 are free to move or oscillate when disturbed, adding an interesting variant to the visual effect of this apparatus.

Figure 10:
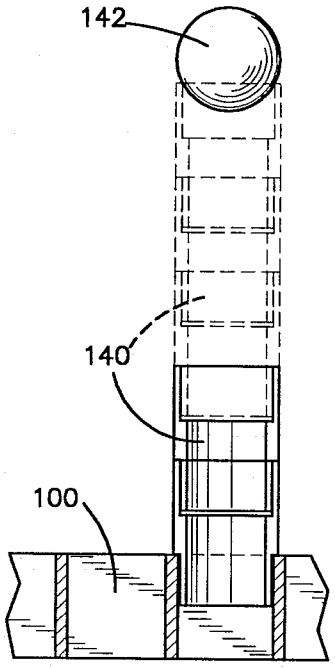
FIG. 10 is a detailed elevational view illustrating a still further embodiment of a portion of the present invention.

Segmented support posts, such as illustrated in FIG. 10, are also possible. In FIG. 10, a support post is made of a series of stackable segments 140 having mutually interfitting ends such that they can be stacked in numbers chosen to govern the height of the support post. In FIG. 10, a segmented support post is illustrated as supporting a marble 142 above the base 100. As in the case of the other support posts described above, the segmented support post of FIG. 10 can be made of clear or colored material and can have different cross-sectional configurations, such as round, rectangular, or other.

The parts of the present apparatus as described in this document can be used and assembled in accordance with a user's imagination to create striking and interesting three dimensional arrays of colored display elements such as marbles. A user can make an assembly having many different elevational levels above the base, and inclined arrays of display pieces as well.

Use of translucent or transparent display pieces or marbles is preferable. Transparency coupled with the openness of configuration of the various assembly parts, allowing light to pass in vertical directions through the arrays, yields often—surprising results in light patterns.

Artificial light sources can be employed in connection with arrays made from the present apparatus to enhance the appearance of arrays created by use of the apparatus.

It is to be understood that this description of a preferred embodiment of the present invention is to be regarded as illustrative rather than exhaustive, of the invention. Those of ordinary skill in the relevant art may be able to make certain additions or modifications to, or deletions from, the preferred embodiment disclosed here without departing from the spirit or the scope of the invention as set forth in the appended claims.

I claim:

1. An apparatus for building stationary three dimensional arrays of substantially spherical visual display elements, said apparatus comprising:

(a) a plurality of said substantially spherical visual display elements;

(b) a base defining recesses adapted to hold substantially without movement said visual display elements by gravity when placed upon said base; and, (c) a plurality of elongated support post each engageable with said base, each support post defining near its distal end a recess for supporting a said visual display element spaced from said base when said post is engaged with said base.

2. The apparatus of claim 1, wherein said posts are substantially round in cross section.

3. The apparatus of claim 1, wherein said posts are substantially rectangular in cross section.

4. The apparatus of claim 1, wherein said posts comprise a substantially transparent material.

5. The apparatus of claim 1, wherein said visual display elements comprise marbles.

6. The apparatus of claim 1, wherein said visual display element supporting structure comprises additional structure mechanically engageable with eat least one of said posts and including means for stationarily supporting on said additional structure one or more of said visual display elements.

7. The apparatus of claim 6, wherein said additional support structure comprises riser structure engageable with a post in an inclined attitude with respect to said base when engaged with said base.

8. The apparatus of claim 7, wherein:

(a) said visual display elements comprise translucent marbles;

(b) said riser structure defines a generally open configuration defining passages therethrough facilitating passage of light through said translucent marbles.

9. The apparatus of claim 1 wherein said support posts each comprise a plurality of stackable segments having mutually interfitting ends which, when mutually fitted together, form a segmented support post.

10. The apparatus of claim 1, wherein:

said support posts are of different heights.

11. The apparatus of claim 1, wherein:

said base comprises a generally flat grid defining passages therethrough.

12. The apparatus of claim 11, wherein:

(a) said passages accommodate placement of said display elements on said grid, and (b) said passages are sufficiently closely spaced that, when display elements are placed in adjacent passages, said display elements substantially touch one another.

13. An apparatus for allowing the building of a stationary three dimensional array of generally spherical visual display elements, said apparatus comprising:

(a) a plurality of translucent generally spherical visual display elements;

(b) a base defining a grid and having recesses for, by gravity, engaging and holding stationary, with respect to said base, visual display elements placed on said base;

(c) structure engageable with a recess of said base and defining a recessed portion for supporting said substantially spherical visual display elements substantially adjacent one another above said base, said supporting structure defining passages therethrough for facilitating the passage of light therethrough in a direction having a vertical component.

14. The apparatus of claim 13, wherein said visual display elements comprise a plurality of translucent marbles of different colors.

15. The apparatus of claim 14, wherein said marbles comprise glass.

16. The apparatus of claim 14, wherein said marbles comprise acrylic.

17. The apparatus of claim 13, wherein said base defines openings and said support structure comprises tubular members of differing lengths, each of said tubular members being uprightly engageable in one of the openings defined by said base.

18. An apparatus for facilitating building a three dimensional stationary array of visual display elements, said apparatus comprising:

(a) a plurality of visual display elements;

(b) a base defining recesses for engaging by gravity a plurality of said visual display elements when placed upon said base, for substantially preventing motion of said visual display elements; and, (c) support structure engageable with said base defining recesses to support a plurality of said visual display elements elevated above said base in a stationary closely spaced array, said structure comprising a structural member adapted for direct contact with said elements and having a thickness dimension much less than its length dimension and support structure being disposed along an inclined path relative to said base, said support structure defining recesses for retaining said display elements stationary and substantially without rolling motion.

19. An apparatus for facilitating the building of a three dimensional array of visual display element, said apparatus comprising:

(a) a generally flat base defining a plurality of recesses;

(b) a plurality of support posts each stationarily engageable with a recess defined by said base with said posts extending in a direction approximately perpendicular to said base, said support posts each defining a recess at its upper end to stationarily hold a visual display element elevated above said base;

(c) a plurality of said visual display elements; and, (d) at least one riser stationarily engageable between said base and one of said support posts in an inclined attitude with respect to said base, said riser also defining recesses for stationarily supporting a plurality of said visual display elements closely spaced and at an elevation intermediate said base and the upper end of said support post.

20. The apparatus of claim 19, wherein at least one of said support posts is substantially rectangular in cross-section.

21. The apparatus of claim 19, wherein:

said riser comprises a ladder-type structure allowing passage of light in a direction having a component substantially perpendicular to said ladder-type structure.

22. An apparatus for facilitating the construction of a stationary three dimensional array of generally rounded visual display elements, said apparatus comprising:

(a) a plurality of said display elements;

(b) a generally flat base defining means for stationarily supporting said visual display elements upon said base in a closely spaced array, while inhibiting rolling movement of said display elements;

(c) a plurality of support posts, each engageable with said base in an attitude extending substantially perpendicular to said base, said support posts each comprising means at its distal end for stationarily supporting thereon one of said rounded visual display elements above said base;

(d) said base comprising a generally planar rectangular open grid defining closely spaced passages therethrough which are smaller than said visual display elements.

23. An apparatus for facilitating the construction of a three dimensional array of visual display elements, said apparatus comprising:

(a) a plurality of generally rounded visual display elements;

(b) a generally flat base defining a substantially open grid configuration and capable of engaging a plurality of said visual display elements placed upon said base in a closely spaced array;

(c) support structure engageable with said base for stationarily supporting in a closely spaced array a plurality of said visual display elements along an inclined path while substantially preventing rolling motion of said visual display elements, said support structure comprising an elongated member.

24. An apparatus for facilitating the building of a three dimensional array of marbles, said apparatus comprising:

(a) a flat base defining a grid, the interstices of said grid accommodating stationary placement of marbles thereon in a closely spaced array;

(b) a plurality of elongated support posts, each engageable at a lower end with said grid, the upper end of each of said support posts being configured to accommodate the placement thereon of a marble;

(c) a plurality of marbles;

(d) at least one generally thin substantially planar platform defining a grid similar to the grid defined by said base, said platform being mountable upon at least one of said support posts to define a plane elevated above the plane of said base for accommodating another closely spaced array of marbles;

(e) at least one elongated riser defining a generally ladder-like configuration, said riser being mountable at an inclined attitude with respect to said base for supporting a closely spaced stationary generally linear array of marbles along a path which is inclined with respect to the base;

(f) each of said platform and said riser defining passages therethrough for allowing the passage of light through said platform and said riser in a direction generally perpendicular to said platform and said riser.

25. An apparatus for facilitating the building of a three dimensional array of generally rounded visual display elements, said apparatus comprising:

(a) a generally flat base;

(b) a plurality of support posts each stationarily engageable with said base with said posts extending in a direction approximately perpendicular to said base, each said support post being constructed at its upper end to stationarily hold a generally rounded visual display element elevated above said base;

(c) a plurality of said generally rounded visual display elements;

(d) at least one riser stationarily engageable between said base and one of said support posts in an inclined attitude with respect to said base, said riser also comprising structure for stationarily supporting a plurality of said generally rounded visual display elements closely spaced and at an elevation intermediate between said base and the upper end of one of said support posts, and (e) platform structure stationarily engageable with at least one of said support posts, said platform structure including means for stationarily supporting a closely spaced array of a plurality of said rounded display elements when placed upon said platform structure, while substantially preventing rolling motion of said visual display elements, and wherein said platform defines a thickness dimension much less than its length or width dimension, and having passages extending therethrough which accommodate placement and stationary positioning of said display elements upon said platform.

26. An apparatus for building stationary three dimensional arrays of substantially spherical visual display elements, said apparatus comprising:

(a) a plurality of said generally spherical visual display elements;

(b) a base comprising a substantially flat grid structure having passages extending therethrough and being adapted to hold without movement said visual display elements when such elements are placed upon said base;

(c) structure comprising elongated tubular support posts engageable to said base for directly supporting said visual display elements spaced from said base on respective upper ends of said posts when said posts are engaged in said base, each of the said upper ends of said posts defining a recess adapted for retaining one of said generally spherical visual display elements.

27. The apparatus of claim 26, wherein:

(a) said passages accommodate placement of said display elements on said grid, and (b) said passages are sufficiently closely spaced that, when display elements are placed on adjacent passages, said display elements substantially touch one another.

28. An apparatus for building stationary three dimensional arrays of translucent marble display elements, said apparatus comprising:

(a) a plurality of said translucent marbles;

(b) a base defining structure including recesses adapted to hold without movement said translucent marbles when placed upon said base;

(c) structure comprising elongated support posts engageable to said base, each defining a recess in its upper end for directly support one of said marbles above said base on respective upper ends of said posts when said posts are engaged in said base, and (d) riser structure engageable with said base and engageable with a post in an inclined attitude with respect to said base when so engaged and having means for supporting said marbles motionless along said inclined path.

(b) a base defining structure including recesses adapted to hold without movement said translucent marbles when placed upon said base;

(c) structure comprising elongated support posts engageable to said base, each defining a recess in its upper end for directly support one of said marbles above said base on respective upper ends of said posts when said posts are engaged in said base, and (d) riser structure engageable with said base and engageable with a post in an inclined attitude with respect to said base when so engaged and having means for supporting said marbles motionless along said inclined path.

29. An apparatus for building stationary three dimensional arrays of substantially round visual display elements, said apparatus comprising:

(a) a plurality of said visual display elements, each comprising a translucent marble;

(b) a base defining structure adapted to hold without movement said visual display elements placed upon said base;

(c) structure comprising elongated tubular support posts engageable to said base for directly supporting said visual display elements above said base on respective upper ends of said posts when said posts are engaged in said base;

(d) additional structure mechanically engageable with at least one of said posts and including means for stationarily supporting on said additional structure one or more of said visual display elements, said additional support structure comprising riser structure engageable with a post in an inclined attitude with respect to said base and defining a generally open configuration defining passages therethrough facilitating passage of light through said translucent marbles.

30. An apparatus for facilitating the building of a three dimensional array of round visual display elements, said apparatus comprising:

(a) a plurality of translucent visual display elements;

(b) a base defining a grid configuration and having means for, by gravity, engaging and holding stationary with respect to said base visual display elements placed on said base, said grid comprising a generally planar rectangular open grid defining openings therein smaller than a dimension of said visual display elements;

(c) structure engageable with said base defining means for supporting visual display elements substantially adjacent one another above said base, said supporting structure defining passages therethrough for allowing the passage of light therethrough in a direction having a vertical component, said supporting structure comprising tubular members uprightly engageable in said openings of said grid.

31. The apparatus of claim 30, wherein said support structure further comprises portions of material similar to that of said grid and being engageable with the upper ends of said uprightly engaged tubular members.

32. An apparatus for allowing the building of a three dimensional array of generally rounded visual display elements, said apparatus comprising:

(a) a generally flat base;

(b) a plurality of support posts each stationarily engageable with said base with said posts extending in a direction approximately perpendicular to said base, said support posts each being constructed at its upper end to stationarily hold a generally rounded visual display element elevated above said base;

(c) a plurality of said generally rounded visual display elements;

(d) at least one riser stationarily engageable between said base and one of said support posts in an inclined attitude with respect to said base, said riser also comprising structure for stationarily supporting a plurality of said generally rounded visual display elements closely spaced and at an elevation intermediate between said base and the upper end of said support posts, and (e) platform structure stationarily engageable with at least one of said support posts, said platform structure including means for stationarily supporting a closely spaced array of said rounded display elements when placed upon said platform structure, said supporting means including structure for substantially preventing rolling motion of said visual display elements.

33. The apparatus of claim 32, wherein said platform defines a thickness dimension much less than its length or width dimension, said platform also defining pass ages therethrough which accommodate placement and stationary positioning of said display elements in a closely spaced array upon said platform.

34. An apparatus for allowing the building of a three dimensional array of generally rounded visual display elements, said apparatus comprising:

(a) a generally flat base;

(b) a plurality of support posts each stationarily engageable with said base with said posts extending in a direction approximately perpendicular to said base, said support posts each being constructed at its upper end to stationarily hold a generally rounded visual display element elevated above said base;

(c) a plurality of said generally rounded visual display elements;

(d) at least one riser stationarily engageable between said base and one of said support posts in an inclined attitude with respect to said base, said riser comprising structure for stationarily supporting a plurailyt of said generally rounded visual display elements closely spaced and at an elevation intermediate between said base and the upper end of said support post, said riser comprising a ladder-type structure allowing passage of light in a direction having a component substantially perpendicular to said ladder-type structure.

* * * * *